United States Patent [19]

Bowers

[11] Patent Number: 5,027,474

[45] Date of Patent: Jul. 2, 1991

[54] CONCEALED SELF-CLOSING HINGE WITH LEAF SPRING

[75] Inventor: Michael J. Bowers, Freeport, Ill.

[73] Assignee: Amerock Corporation, Rockford, Ill.

[21] Appl. No.: 574,907

[22] Filed: Aug. 30, 1990

[51] Int. Cl.[5] ..... E05F 1/08

[52] U.S. Cl. ..... 16/297; 16/303; 16/335; 16/341; 16/342; 16/379; 16/380; 16/50

[58] Field of Search ..... 16/235, 296, 297, 303, 16/335, 341, 342, 333, 347, 379, 361, 380, 50

[56] References Cited

U.S. PATENT DOCUMENTS

| | | | |
|---|---|---|---|
| 3,228,058 | 1/1966 | MacDonald | 16/335 |
| 3,237,239 | 3/1966 | Rudnick | 16/335 |
| 4,114,236 | 9/1978 | Vandervort | 16/335 |
| 4,654,930 | 4/1987 | Laufenschlager, Jr. et al. | 16/296 |
| 4,716,622 | 1/1988 | DeBruyn | 16/297 |

FOREIGN PATENT DOCUMENTS

| | | | |
|---|---|---|---|
| 2155606 | 5/1973 | France | 16/50 |
| 1067857 | 5/1967 | United Kingdom | 16/297 |

*Primary Examiner*—Richard K. Seidel
*Assistant Examiner*—Edward A. Brown
*Attorney, Agent, or Firm*—Leydig, Voit & Mayer

[57] ABSTRACT

A concealed self-closing hinge for mounting a door for swinging on a fixed frame. The door member of the hinge includes a cup which is concealed within a pocket formed in the inner side of the door. A durable plastic cam on the arm of the frame member of the hinge receives a hinge pin which is disposed in slots in the cup. A leaf spring is supported by the base of the cup and is bowed around a bridge to bear against and ride on the cam to effect the self-closing action and also to hold the hinge pin assembled in the slots in the cup.

3 Claims, 2 Drawing Sheets

CONCEALED SELF-CLOSING HINGE WITH LEAF SPRING

FIELD OF THE INVENTION

The present invention relates in general to a self-closing hinge for mounting a cabinet door for swinging between open and closed positions on a cabinet frame and, more particularly, to a self-closing hinge which is concealed from view from the front of the cabinet.

BACKGROUND OF THE INVENTION

Self-closing hinges customarily include door and frame members mountable on a door and frame, respectively, and interconnected by a hinge pin. Spring means are carried by the door member of the hinge and act against part of the frame member of the hinge. After the door has been swung a predetermined distance from its open position toward its closed position, the spring means cause the door to swing the rest of the way closed and resiliently hold the door in its closed position.

More specifically, the invention relates to a concealed self-closing hinge of the same general type as disclosed in DeBruyn U.S. Pat. No. 4,716,622. In such a hinge, the door member is, for the most part, formed by a cup which is adapted to nest within a pocket formed in the inner side of the door. The hinge pin is supported by the cup and is connected to the frame member of the hinge in such a manner that, when the door is fully closed, virtually all parts of the hinge are concealed from view from the front of the cabinet.

In the hinge of the DeBruyn patent, the cup is stamped from sheet metal. Moreover, the frame member includes an arm which is stamped of sheet metal and which includes a curl wrapped around the hinge pin. The spring means is a one-piece leaf spring which bears against and rides on the curl.

The stamped sheet metal components of the DeBruyn hinge are relatively expensive to manufacture and assemble. In addition, the metal-to-metal contact between the curl and the spring produces relatively rapid wear and eventually results in deterioration of the hinge.

SUMMARY OF THE INVENTION

The general aim of the present invention is to provide a new and improved hinge of the foregoing type which is less expensive to manufacture and assemble and which is quieter, smoother and more durable in operation.

A more detailed object of the invention is to achieve lower cost by providing a hinge in which the cup-like door member is die cast from metal, in which the hinge pin is assembled simply by slipping it into slots in the cup, and in which the leaf spring is used to advantage to retain the hinge pin in assembled relation with the cup.

The invention also resides in the provision of a plastic cam which is supported on the hinge pin and which coacts with the leaf spring to effect the self-closing action without significant wear.

These and other objects and advantages of the invention will become more apparent from the following detailed description when taken in conjunction with the accompanying drawings.

DETAILED DESCRIPTION OF THE PREFERRED EMBODIMENT

Figure 1:
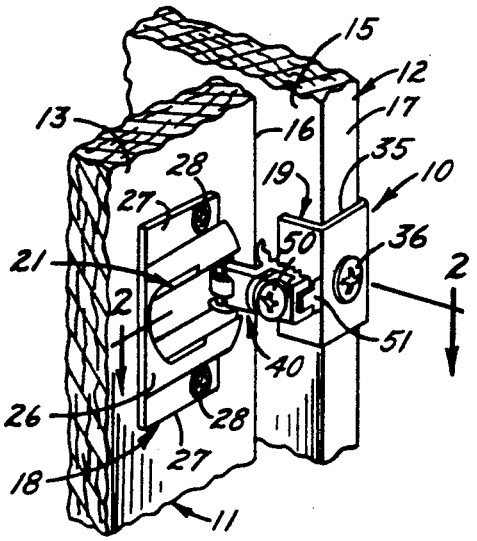
FIG. 1 is a fragmentary perspective view showing a cabinet door swingably mounted on a cabinet frame by a new and improved hinge incorporating the features of the present invention.

For purposes of illustration, the hinge 10 of the present invention is shown in the drawings as being used for mounting a substantially solid door 11 made of wood or other non-metallic material for swinging between open and closed positions on the frame 12 of a kitchen cabinet. In this instance, the door is of the overlay type in that, when the door is closed, the inner and outer face surfaces 13 and 14 of the door overlap the outer face surface 15 of the frame while the hinged edge surface 16 of the door is spaced laterally from the adjacent parallel edge surface 17 of the frame.

As shown in FIG. 1, the hinge compises door and frame members 18 and 19 adapted to be mounted on the door 11 and the frame 12, respectively. The door member 18 is adapted to be mounted within a cylindrical bore or pocket 25 formed in the inner surface 13 of the door in order to conceal the hinge from view from the front of the cabinet. In the illustrated embodiment, the door member 18 preferably is die cast of metal and comprises a generally box-like cup 21 with a substantially open end adjacent the inner surface 13 of the door. The cup includes arcuate wall sections 22 (FIG. 5) on two sides of the cup to locate the cup within the cylindrical pocket 25 of the door. A flange 26 extends around and transversely from the open end of the cup and lies substantially flush with the inner surface 13 of the door. Two oppositely extending mounting plates 27 are formed integrally with the flange 26 and are disposed face-to-face with the inner surface 13 of the door. Screws 28 extend through the mounting plates 27 to fasten the door member 18 of the hinge securely to the door.

Figure 2:
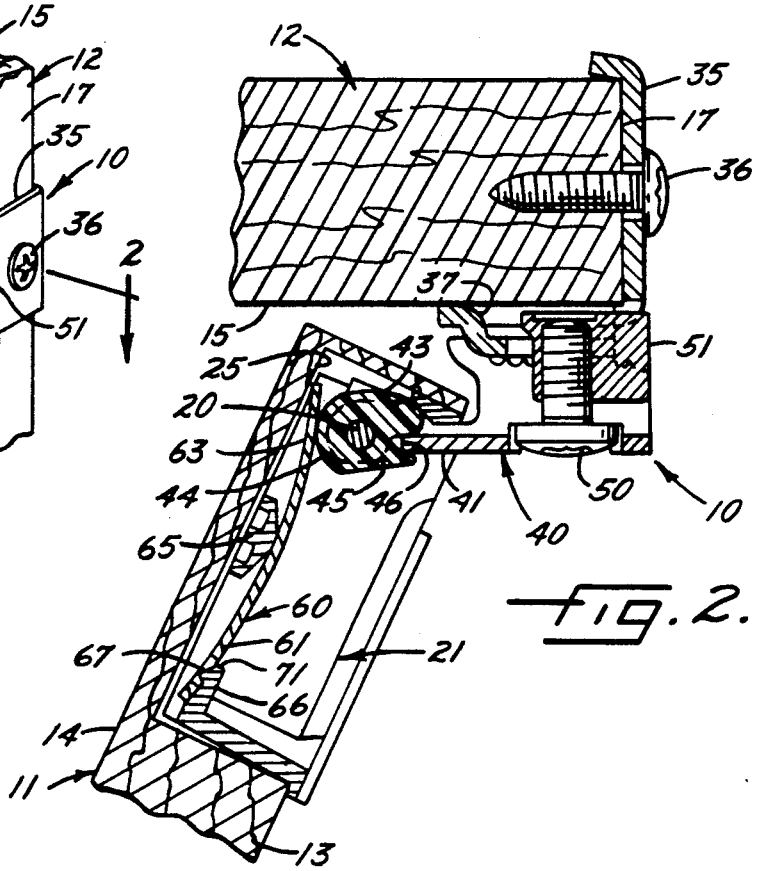
FIG. 2 is an enlarged fragmentary cross-section taken substantially along the line 2—2 of FIG. 1 and shows the door in a fully open position.

As illustrated in FIGS. 1 and 2, the frame member 19 of the hinge 10 includes a stamped metal mounting wing 35 which lies against the edge surface 17 of the frame 12 and which is fastened to the frame by a screw 36. A second wing 37 is formed integrally with and disposed at right angles to the wing 35 and lies against the outer surface 15 of the frame. An arm 40 stamped from sheet metal is secured to the wing 37 and is adapted to enable lateral adjustment of the door 11 on the frame 12. In the illustrated embodiment, the arm 40 includes a channel-shaped portion with serrated edges which rest against the wing 37. A screw 50 extends through the arm into a T-shaped fastening member 51 which is disposed in an opening in the wing and the channel of the arm to secure the arm 40 to the wing 37. It will be appreciated that alternative laterally adjustable fastening methods could be used to secure the arm to the wing.

Additionally, the arm 40 includes a free end section 41 which extends into the cup 21 of the door member 18. To pivotally connect the door and frame members 18 and 19, a hinge pin 20 is disposed in the cup and the free end section 41 of the arm 40 is connected to the hinge pin.

Figure 4:
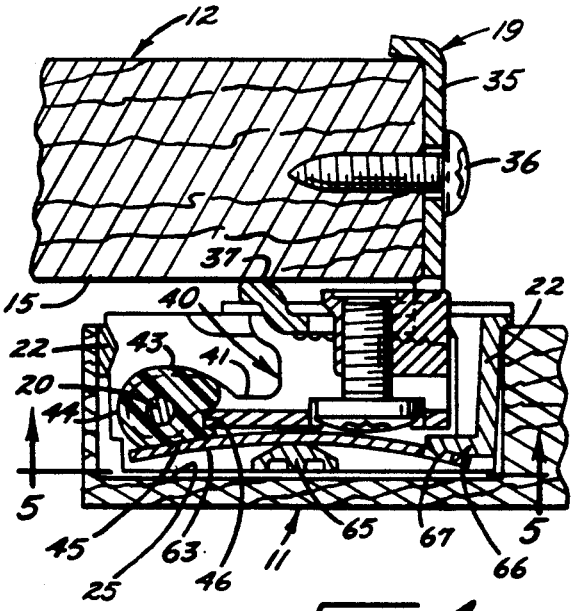
FIG. 4 also is a view similar to FIG. 2 but shows the door in a fully closed position.

As shown in FIG. 4, with the door 11 in its fully closed position, virtually the entire arm 40 is disposed within and is concealed by the cup 21. In addition, the cup conceals the frame wing 37. Since the cup itself is located within the pocket 25 in the door, the entire hinge 10 is concealed with respect to the front face 14 of the door and is virtually invisible from the edge surface 16 of the door.

Advantageously, the free end section 41 of the arm 40 forms a clevis having opposed apertured lugs 42 (FIG. 5) with an apertured cam 43 disposed between the lugs. In this particular instance, the lugs receive the hinge pin with running clearance while the cam receives the pin with a tight press fit so that the cam and pin are fixed as a unit. The cam 43 is made of a durable, wear-resistant plastic and the outer nose 44 of the cam is arcuately formed and extends beyond the opposed lugs 42 of the clevis. The opposite end portion of the cam 43 is formed with a groove 46 which receives the arm 40 between the lugs 42 of the clevis to secure the position of the cam 43 and prevent rotation of the cam about the hinge pin 20.

Figure 6:
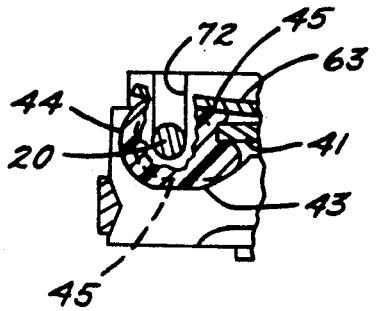
FIG. 6 is a fragmentary cross-section taken substantially along the line 6—6 of FIG. 5.

In accordance with the present invention, a leaf spring 60 is supported by the cup 21 and bears against the cam 43 to effect self-closing of the hinge 10 after the door has been swung part way toward its closed position, the spring also uniquely serving to hold the hinge pin 20 in assembled relation with the cup. As shown in FIG. 6, the leaf spring 60 comprises a flat plate 61 made of resiliently yieldable hard tempered steel with a hole 62 in one end of the plate for securing the spring to the cup.

In the illustrated embodiment, the spring 60 is disposed adjacent the outer end of the cup 21. The outer end of the cup is defined by two parallel and generally horizontal walls 70 (FIG. 5) extending outwardly at right angles to the flange 26 and the mounting plates 27 and extending between the arcuate sections 22. A bridge 65 is formed integrally with and extends between the walls 70 intermediate the ends thereof and adjacent the outer end of the cup. A flange 66 with a locking detent 67 is spaced in one direction from the bridge 65 and also is formed integrally with and extends between the walls 70 adjacent the ends of the walls. As a result of the spaced relation of the flange from the bridge, an opening 71 is formed through the cup between the flange and the bridge.

The ends of the walls 70 opposite the flange 66 are formed with opposing slots 72 (FIGS. 5 and 6) which are spaced from the bridge 65 and which open out of the outer end of the cup 21. The hinge pin 20 is adapted to be slipped into the slots 72 from the outer end of the cup and is adapted to turn relative to the slots during opening and closing of the door 11.

The spring 60 is positioned such that the end portion of the spring containing the hole 62 rests on the flange 66 outside the cup 21. The hole 62 receives the detent 67 to hold the spring. As shown in FIGS. 2 to 5, the spring extends into the cup through the opening 71 and is bowed around the inner side of the bridge, the inner side of the flange 66 being inclined to facilitate bowing of the spring. The free end portion 63 of the spring bears against the cam 43. As a result of the spring being bowed, the free end portion of the spring is resiliently loaded against the cam.

When the door 11 is in its fully open position shown in FIG. 2, the free end portion 63 of the spring 60 bears against a full arcuate portion of the outer nose 44 of the cam 43. Due to this pressing on the cam 43 by the spring 60, there is a frictional resistance opposing free swinging of the door 11 and thus the door tends to remain in the open position. When the door is fully open, the inner face surface 13 is disposed at an angle of about 120 degrees relative to the outer face surface 15 of the frame 12, further opening of the door being prevented by virtue of the inner side of a wall section of the cup 21 engaging the free end section 41 of the arm 40.

Figure 3:
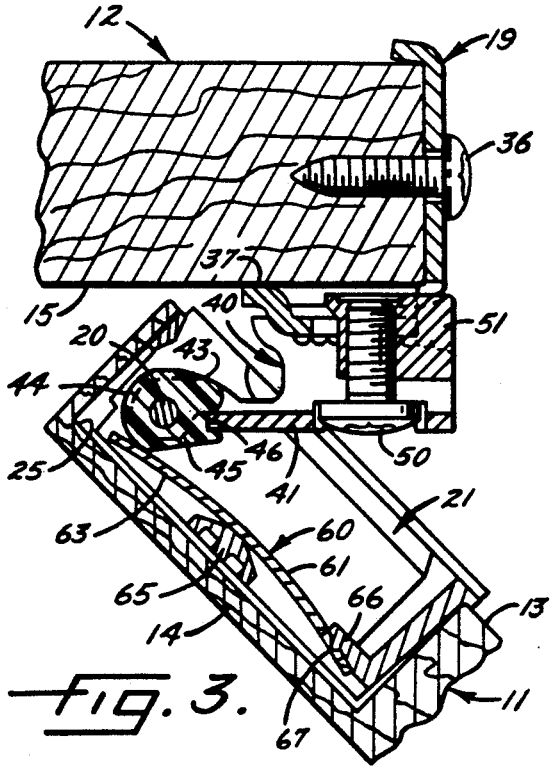
FIG. 3 is a view similar to FIG. 2 but shows the door in a partially open position.

As the door 11 is swung from its fully open position toward its closed position, the free end portion 63 of the spring 60 rides around the cam 43 and continues to frictionally restrict free movement of the door until the door reaches an angle of about 25 degrees relative to the frame as illustrated in FIG. 3. At this position, the free end portion 63 of the spring 60 leaves the full arcuate surface of the cam 43 and begins bearing against a gradually radiused face 45 of the cam. As the free end portion 63 of the spring leaves the arcuate surface of the cam 43, energy stored in the spring 60 is released and acts through the free end portion of the spring and the gradually radiused face 45 of the cam to snap the door to its fully closed position shown in FIG. 4. In the fully closed position of the door, the free end portion 63 of the spring 60 lies substantially in face-to-face relation with the gradually radiused face 45 of the cam 43 and defines a resilient latch for holding the door closed. Before the door may be opened, sufficient force must be exerted on the door to cam and deflect the free end portion 63 of the spring past the gradually radiused face 45 of the cam 43 and into engagement with the arcuate surface 44 of the cam. Such deflection loads the spring so that the spring may subsequently effect self-closing of the door as the latter next approaches its closed position.

It will be appreciated that due to the durable wear-resistant plastic material of the cam 43, operation of the spring against the cam is smooth and quiet. Additionally, wear on the cam is reduced resulting in a longer working life of the hinge.

Figure 5:
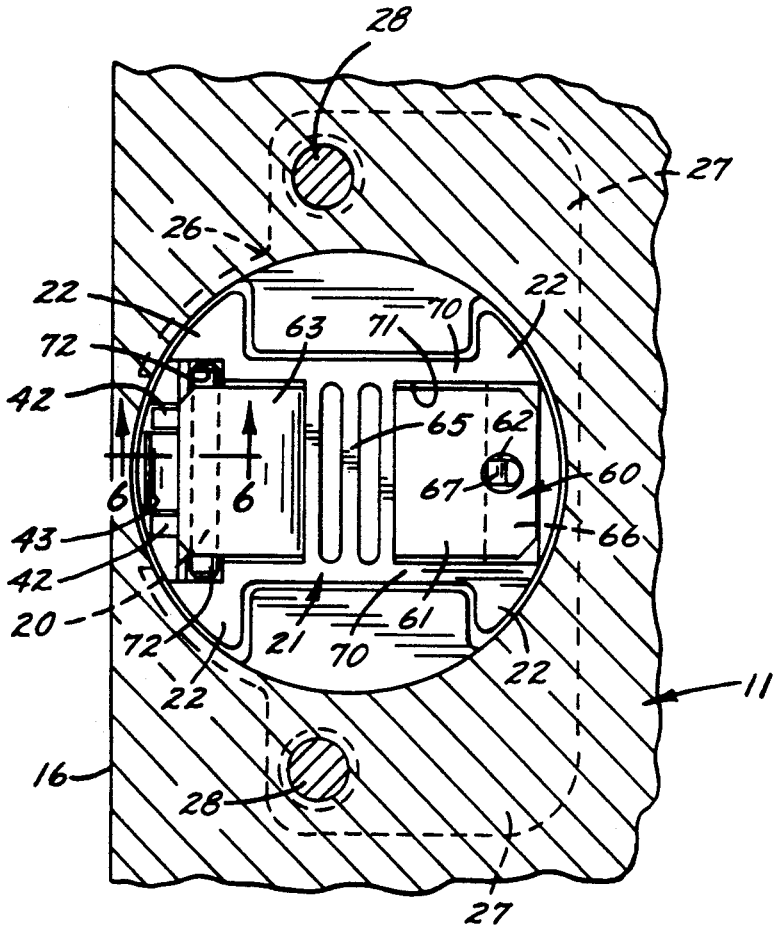
FIG. 5 is an enlarged fragmentary cross-section taken substantially along the line 5—5 of FIG. 4.
Figure 7:
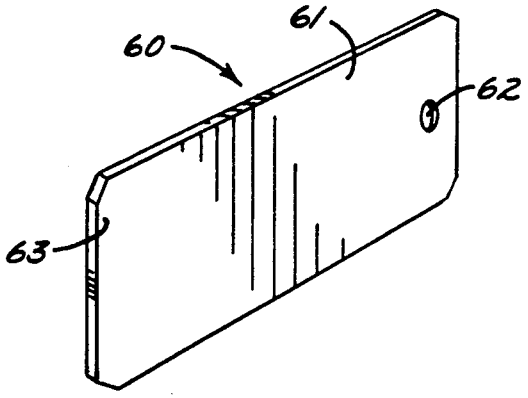
FIG. 7 is a perspective view of the leaf spring.

Importantly, the spring also performs the additional function of securing the hinge pivot means in its assembled relation. As previously mentioned, the hinge pin 20 with the arm 40 of the frame member 19 secured thereto is disposed in the slots 72 in the walls 70 of the cup. The walls are spaced apart such that the opening which exists between the walls is just slightly larger than the height of the opposed lugs 42 of the arm 40 so as to substantially secure the arm against axial movement with respect to the cup. As illustrated in FIG. 5, the spring 60 is disposed to bear against the cam 43 and thus the force of the spring on the cam 43 is transmitted to the hinge pin 20 in order to retain the hinge pin in the slots 72 and to prevent the pin from escaping out of the open inner ends of the slots.

It will be noted that this hinge pin mounting arrangement facilitates relatively easy assembly of the door and frame members 18 and 19. The hinge pin 20 with the arm 40 connected thereto is merely slipped into the slots 72 in the cup 21 of the door member 18 from the outer side of the cup. The leaf spring 60 is then installed and is positioned to bear against the cam 43 carried by the hinge pin so as to secure the hinge pin in the slots 72 and thus pivotally connect the door and frame members.

From the foregoing, it will be apparent that the present invention provides a concealed self-closing hinge of the cup-type for mounting a door on the frame of a kitchen cabinet in which the self-closing action is effected by a leaf spring which bears against a durable plastic cam for smooth and quiet operation of the hinge. The hinge pin for pivotally connecting the door and frame members is disposed in slots in the cup of the door member and is secured therein by the force of the spring acting against the cam of the frame member.

I claim:

1. A concealed self-closing hinge for mounting a door for swinging on a fixed frame, said hinge comprising a door member having a cup mountable i the door, said cup having an open end and an opposite second end, said cup having a bridge adjacent the second end of said cup, said cup having a flange at the second end of the cup and spaced from one side of said bridge whereby an opening into the cup is defined between said flange and said bridge, opposing slots formed in said cup on another side of said bridge and spaced from said bridge, said slots opening out of the second end of said cup, a hinge pin having end portions disposed in said slots, said hinge further comprising a frame member having a wing for mounting the frame member on said frame, an arm having one end attached to the wing of said frame member and extending into the cup from the open end thereof, the opposite end of said arm being supported on said hinge pin to pivotally connect said door and frame members, a cam on said arm and supported on said hinge pin, and a spring for urging said door member to and releasably holding said door member in a closed position with respect to the frame member, said spring comprising a generally flat plate of resiliently yieldable material and being non-integral with said cup, said spring having a first end portion bearing against said flange outside of the interior of said cup, having an intermediate portion extending into said interior of said cup through said opening and bowed around said bridge, and having a second end portion bearing against said cam, said second end portion of said spring exerting a biasing force on said cam and retaining said hinge pin in said slots.

2. A concealed self-closing hinge for mounting a door for swinging on a fixed frame, said hinge comprising a door member having a plate for mounting the door member on said door, a cup formed integrally with and extending from said plate and having an open end located adjacent said plate and an opposite second end, said cup being defined in part by two generally parallel walls extending at right angles to said plate and each having first and second ends, a bridge formed integrally with and extending between the walls intermediate the ends thereof and adjacent the second end of said cup, a flange formed integrally with and extending between the walls at the first ends thereof and spaced from said bridge whereby an opening is defined between said flange and said bridge, opposing slots formed in the walls adjacent the second ends thereof and spaced from said bridge, said slots opening out of the second end of said cup, a hinge pin extending substantially perpendicular to the walls and having end portions disposed in said slots, said hinge further comprising a frame member having a wing for mounting the frame member on said fixed frame, an arm having one end attached to the wing of said frame member and extending into the cup, a cam disposed on the opposite end of said arm and supported on said hinge pin to pivotally connect said door and frame members, and a spring for urging said door member to and releasably holding said door member in a closed position with respect to the frame member, said spring comprising a generally flat plate of resiliently yieldable material and being non-integral with said cup, said spring having a first end portion bearing against said flange outside of the interior of said cup, having an intermediate portion extending into said interior of said cup through said opening and bowed around said bridge, and having a second end portion bearing against said cam, said second end portion of said spring exerting a biasing force on said cam and retaining said hinge pin in said slots.

3. A concealed self-closing hinge as defined in claim 2 wherein said cam is made of a durable plastic material and is non-integral with said arm of said frame member, said arm including a clevis having opposing lugs for supporting said hinge pin, said plastic cam being supported on said hinge pin between said lugs.

* * * * *